US008953967B2

(12) United States Patent
Hase

(10) Patent No.: US 8,953,967 B2
(45) Date of Patent: Feb. 10, 2015

(54) FIXATION DEVICE HAVING TEMPERATURE CONTROL AND IMAGE FORMING APPARATUS INCLUDING THE SAME

(75) Inventor: Takamasa Hase, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 533 days.

(21) Appl. No.: 13/147,896

(22) PCT Filed: Mar. 2, 2010

(86) PCT No.: PCT/JP2010/053724

§ 371 (c)(1),
(2), (4) Date: Aug. 4, 2011

(87) PCT Pub. No.: WO2010/106932

PCT Pub. Date: Sep. 23, 2010

(65) Prior Publication Data

US 2011/0293309 A1 Dec. 1, 2011

(30) Foreign Application Priority Data

Mar. 18, 2009 (JP) ..... 2009-065453

(51) Int. Cl.
*G03G 15/20* (2006.01)

(52) U.S. Cl.
CPC .... *G03G 15/2078* (2013.01); *G03G 2215/2032* (2013.01)
USPC ..... 399/70; 399/69

(58) Field of Classification Search
USPC ..... 399/69, 70
See application file for complete search history.

(56) References Cited

U.S. PATENT DOCUMENTS 4,385,826 A * 5/1983 Itoh ..... 399/70
4,609,278 A * 9/1986 Taniguchi ..... 399/70

(Continued)

FOREIGN PATENT DOCUMENTS

JP 11 249489 9/1999
JP 2002 108133 4/2002

(Continued)

OTHER PUBLICATIONS

International Search Report issued Mar. 30, 2010 in PCT/JP10/53724 filed Mar. 2, 2010.

(Continued)

*Primary Examiner* — David Gray
*Assistant Examiner* — Milton Gonzalez
(74) *Attorney, Agent, or Firm* — Oblon, Spivak, McClelland, Maier & Neustadt, L.L.P.

(57) ABSTRACT

A fixation device includes a fixation member including a heating member, a pressure-application member press-contacting the fixation member forming a nip portion, an exciting coil induction-heating the heating member, a first temperature detection unit detecting a first temperature of the pressure-application member or a first ambient temperature of the fixation member, a second temperature detection unit detecting a second temperature of the fixation member, and a control unit selecting a temperature control mode or power control mode controlling power to the exciting coil. When the first temperature exceeds a first threshold temperature or the first ambient temperature exceeds a first ambient threshold temperature, the control unit selects the temperature control mode, and while the first temperature is equal to or lower than the first threshold temperature or the first ambient temperature is equal to or lower than the first ambient threshold temperature, the control unit selects the power control mode.

8 Claims, 12 Drawing Sheets

(56) References Cited

U.S. PATENT DOCUMENTS

| | | | | |
|---|---|---|---|---|
| 5,436,430 | A * | 7/1995 | Baruch et al. | 219/216 |
| 5,600,406 | A * | 2/1997 | Aikawa et al. | 399/70 |
| 6,185,388 | B1 | 2/2001 | Yamamoto | |
| 6,346,800 | B1 * | 2/2002 | Mano et al. | |
| 2002/0061200 | A1 | 5/2002 | Sakakibara et al. | |
| 2004/0202490 | A1 * | 10/2004 | Okamoto | 399/69 |
| 2005/0201768 | A1 | 9/2005 | Tatematsu et al. | |
| 2006/0039713 | A1 | 2/2006 | Kishi et al. | |
| 2006/0051113 | A1 * | 3/2006 | Kishi et al. | 399/70 |
| 2009/0148205 | A1 | 6/2009 | Seo et al. | |
| 2009/0169232 | A1 | 7/2009 | Kunii et al. | |
| 2009/0245897 | A1 | 10/2009 | Seo et al. | |
| 2009/0297197 | A1 | 12/2009 | Hase | |
| 2009/0297199 | A1 * | 12/2009 | Yamashina et al. | 399/70 |
| 2010/0061753 | A1 | 3/2010 | Hase | |
| 2011/0194870 | A1 | 8/2011 | Hase et al. | |
| 2011/0222929 | A1 | 9/2011 | Fujimoto et al. | |

FOREIGN PATENT DOCUMENTS

| | | | |
|---|---|---|---|
| JP | 2004-78181 | A | 3/2004 |
| JP | 2005 257945 | | 9/2005 |
| JP | 2006 39027 | | 2/2006 |
| JP | 2006 58732 | | 3/2006 |
| JP | 2007-128037 | A | 5/2007 |
| JP | 2007-212893 | A | 8/2007 |
| JP | 2007 226028 | | 9/2007 |
| JP | 2007 299010 | | 11/2007 |
| JP | 2008 20827 | | 1/2008 |
| JP | 2008 145871 | | 6/2008 |
| JP | 2009-31637 | A | 2/2009 |
| JP | 2009 175679 | | 8/2009 |
| JP | 2009 288725 | | 12/2009 |
| JP | 2009 294331 | | 12/2009 |

OTHER PUBLICATIONS

Office Action issued Oct. 15, 2013 in Japanese Patent Application No. 2009-065453.

* cited by examiner

FIXATION DEVICE HAVING TEMPERATURE CONTROL AND IMAGE FORMING APPARATUS INCLUDING THE SAME

TECHNICAL FIELD

The present invention relates to an electromagnetically induction-heating type fixation device and an image forming apparatus having such a fixation device.

BACKGROUND ART

The electromagnetically induction-heating type fixation device is, for example, configured to generate a magnetic flux by applying a high-frequency pulse to an exciting coil so as to induce a material to generate heat. Unlike a heat roller type fixation device, since the electromagnetically induction-heating type fixation device having such a configuration is capable of inducing the material to generate heat by itself, the fixation device does not require preheating. That is, the fixation device of this type can instantly increase the temperature of the material to a predetermined level. Accordingly, the fixation device of this type can reduce warm-up time to allow for energy conservation. The fixation device of this type often uses the maximum power thereof in a power control mode at the start-up to save warm-up time.

However, the fixation device of this type is designed to have small heat capacity, and can therefore raise its temperature to a target temperature in several seconds if the fixation device starts up with a certain preheated temperature in a preheating mode. However, this electromagnetically induction-heating type fixation device may cause, after having reached the target temperature, temperature overshoot that exceeds the target temperature of the fixation device. The temperature of the fixation device after temperature overshoot may not be stabilized until several seconds have elapsed. Accordingly, inconsistent gloss or hot offset may be observed in images of several sheets (pages) from the first sheets starting to pass through the fixation device, due to fixation of toner on the printing sheets on the fixation belt having the unstable temperature.

To overcome such a drawback, a technology is proposed to control the amount of current applied to the exciting coil based on a preheated condition of the fixation device before the application of current to the exciting coil. For example, Japanese Laid-Open Patent Application No. 2005-257945 discloses a technology in which a fixation device is initially activated in a power control mode to apply the current to an exciting coil, and when the temperature of an image heating member (i.e., fixation belt) reaches a certain temperature (i.e., difference between fixation belt temperature and image fixation setting temperature), then the power control mode of the fixation device is switched to a temperature control mode. More specifically, in the disclosed fixation device, a control value (proportionality coefficient Kp) of PID control in the temperature control mode is changed based on a previously accumulated heat of the fixation belt before the application of current to the exciting coil. That is, if the temperature of the image heating member (fixation belt) is equal to or more than the default value before the application of current to the exciting coil, the control value of the PID is reduced. In this manner, the temperature of the fixation belt, after having reached the target temperature thereof, can be prevented from overshooting. In contrast, if the temperature of the fixation belt is lower than the default value before the application of current, the control value of the PID is increased. In this manner, the ascending speed of the temperature of the fixation belt can largely be increased.

In addition, Japanese Laid-Open Patent Application No. 2006-058732 discloses a technology in which whether to apply the power from an auxiliary power unit (capacitor) is determined based on the temperature of the fixation device before the application of current to an exciting coil. If the temperature is equal to or higher than a threshold temperature, the current is not applied to the exciting coil. In this manner, the temperature of the fixation device, after having reached the target temperature thereof, can be suppressed from overshooting. In contrast, if the temperature of the fixation device is lower than a threshold temperature, the current is applied to the exciting coil. In this manner, the ascending speed of the temperature of the fixation device can largely be increased.

However, in the technology disclosed in Japanese Laid-Open Patent Application No. 2005-257945, even if the power control mode of the fixation device is switched to the temperature control mode when the temperature of the fixation belt reaches the temperature obtained by the difference between fixation belt temperature and image fixation setting temperature, the overshooting of the target temperature of the fixation belt (image heating member) may not be sufficiently suppressed to prevent image degradation. Further, in the technology disclosed in Japanese Laid-Open Patent Application No. 2006-058732, even if the power from an auxiliary power unit is not supplied to the fixation device, the fixation device at start-up is consistently operated in the power control mode. Thus, the overshooting of the target temperature of the fixation belt at the start-up of the fixation device may not be suppressed.

In the technology in Japanese Laid-Open Patent Application No. 2005-257945, the fixation device is initially activated in the power control mode and then the power control mode is switched into the temperature control mode. However, time required for switching the power control mode to the temperature control mode while the fixation device is in the power control mode requires a full control period. Moreover, the power of the fixation device may not instantly drop. Note that the speed of increasing temperature in the induction-heating type fixation device is extremely fast. Accordingly, if a pressure-application member is configured to store heat, the temperature rise speed of the fixation belt is too fast to suppress the overshoot temperature by adjusting the control value of the PID control in the temperature control mode. Therefore, the overshoot temperature of the fixation belt may not be prevented. In other technologies, the start-up speed of the fixation device is more focused than the overshoot temperature of the fixation member, so that the fixation device starts up in the power control mode. However, as the melting point of toner is increasingly made low, wax in toner vaporizes (ejects) and the vaporized wax is attached to members in the vicinity of the nip portion. Since accumulation of such wax attachments degrades image formation, the overshoot temperature of the fixation member needs to be suppressed.

SUMMARY OF THE INVENTION

Accordingly, it is a general object of the present invention to provide a novel and useful fixation device capable of reducing warm-up time at start-up of the image forming apparatus while suppressing overshoot temperature of a fixation member, and an image forming apparatus having such a fixation device.

According to one aspect of the present invention, a fixation device includes a fixation member configured to include a heating member; a pressure-application member configured to press-contact the fixation member to form a nip portion therebetween; an exciting coil configured to induction-heat the heating member of the fixation member; a first temperature detection unit configured to detect one of a first temperature of the pressure-application member and a first ambient temperature of the fixation member; a second temperature detection unit configured to detect a second temperature of the fixation member; and a control unit configured to select one of a temperature control mode and a power control mode to control electric power supplied to the exciting coil. In the fixation device, when the first temperature of the pressure-application member detected by the first temperature detection unit exceeds a first threshold temperature or the first ambient temperature of the fixation member detected by the first temperature detection unit exceeds a first ambient threshold temperature upon receiving a signal indicating that current has been applied to the exciting coil, the control unit selects the temperature control mode in which the electric power supplied to the exciting coil is determined based on the second temperature of the fixation member detected by the second temperature detection unit. Further, in the fixation device, when the first temperature of the pressure-application member detected by the first temperature detection unit is equal to or lower than the first threshold temperature or the first ambient temperature of the fixation member detected by the first temperature detection unit is equal to or lower than the first ambient threshold temperature upon receiving a signal indicating that the current has been applied to the exciting coil, the control unit selects the power control mode in which a predetermined constant electric power is continuously supplied to the exciting coil.

According to another aspect of the present invention, an image forming apparatus includes the fixation device described above.

Other objects, features, and advantages of the present invention will become more apparent from the following detailed description when read in conjunction with the accompanying drawings.

BEST MODE FOR CARRYING OUT THE INVENTION

Preferred embodiments of the present invention are described below with reference to the accompanying drawings. First, descriptions of overall configuration and operation of an image forming apparatus according to an embodiment of the invention are given below with reference to FIG. 1.

Figure 1:
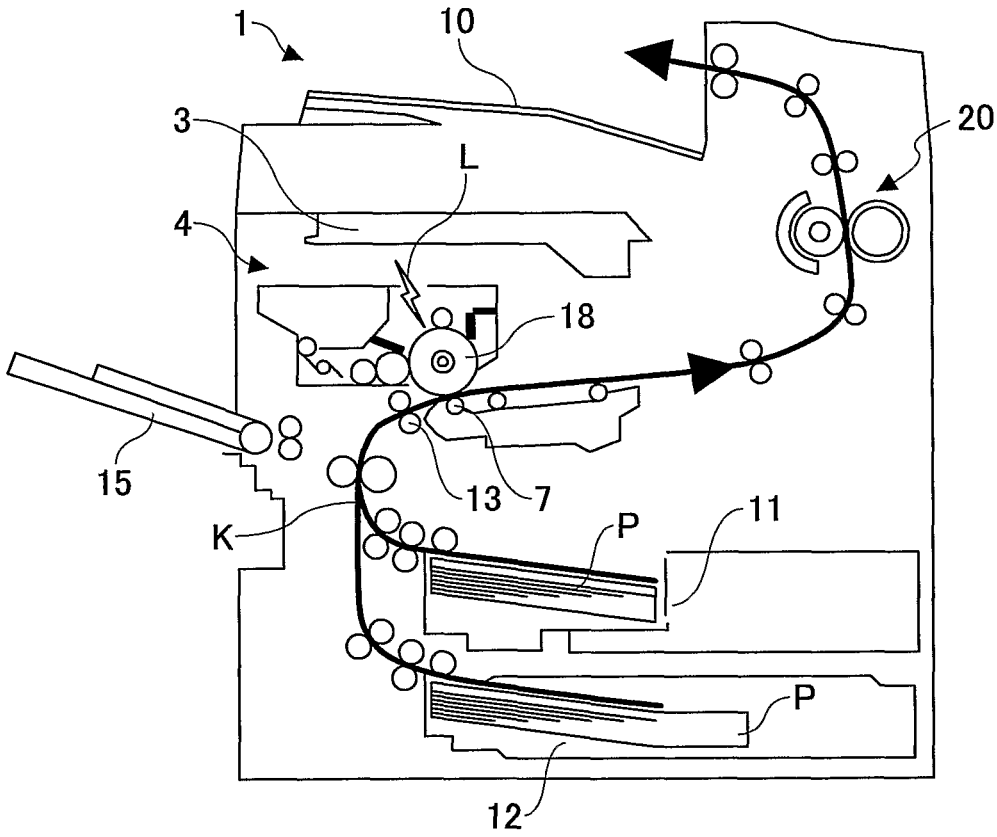
FIG. 1 is a cross-sectional diagram illustrating a configuration of an image forming apparatus according to an embodiment of the invention.

As illustrated in FIG. 1, an image forming apparatus 1 serving as a laser printer main body includes a photoreceptor drum 18, an exposure unit 3 exposing the photoreceptor drum 18 to an exposure light beam L based on image information, a process cartridge 4 removably attached to the image forming apparatus 1 as an image forming unit, a transfer unit 7 transferring a toner image formed on the photoreceptor drum 18 to the recording medium P, paper feeds 11 and 12 each containing a recording medium P such as transferring paper, resist rollers 13 conveying the recording medium P to the transfer unit 7, a manual bypass paper feed 15 for use in feeding a recording medium P having a different size from that of the recording medium P contained in the paper feeds 11 and 12, and a fixation device 20 fixating an unfixated image on the recording medium P.

Referring to FIG. 1, operations of the image forming device for forming images are described.

First, the exposure unit 3 (writing unit) emits an exposure light beam L based on image information toward the photoreceptor drum 18 of the process cartridge 4. The photoreceptor drum 18 rotates in a counterclockwise direction, and a toner image corresponding to the image information is formed on the photoreceptor drum 18 via predetermined image forming processes (i.e., charging step, exposure step, and development step).

Thereafter, the toner image formed on the photoreceptor drum 18 is transferred by the transfer unit 7 to the recording medium P conveyed from the resist rollers 13.

The recording medium P is conveyed to the transfer unit 7 in the following manner. First, one of the paper feeds 11 and 12 is selected either manually or automatically (e.g., the upper paper feed 11 is selected in this case). The respective paper feeds 11 and 12 contain recording media P having different sizes or recording media P having different conveyance directions but the same paper sizes.

One of the recording media P located at the top is conveyed in a direction toward a conveyance path K. The recording medium P then passes through the conveyance path K to reach the resist rollers 13. The recording medium P at the resist rollers 13 is then conveyed in a direction toward the transfer unit 7 by adjusting time such that the toner image formed on the photoreceptor drum 18 is accurately located on the recording medium P.

After having passed through the position of the transfer unit 7 in a transfer step, the recording medium P reaches the fixation device 20. The recording medium P at the fixation device 20 is conveyed into a gap between a fixation sleeve 22 and a pressure-application roller 23, in which the toner image is fixated on the recording medium P by the application of heat and pressure from the respective fixation sleeve 22 and the pressure-application roller 23. The recording medium P having a fixated toner image thereon is conveyed from the gap between the fixation sleeve and the pressure-application roller 23, output from the image forming apparatus 1, and placed on a receiving tray 10. A sequence of image forming processes is completed in this manner. The image forming apparatus 1 in this embodiment is a monochromatic print type apparatus; however, it may be converted into a heterochromatic print type apparatus by setting four CMYK colors in the process cartridge 4.

Next, a configuration and operations of the fixation device 20 according to the embodiment placed in the image forming apparatus (main body) 1 is described.

Figure 2:
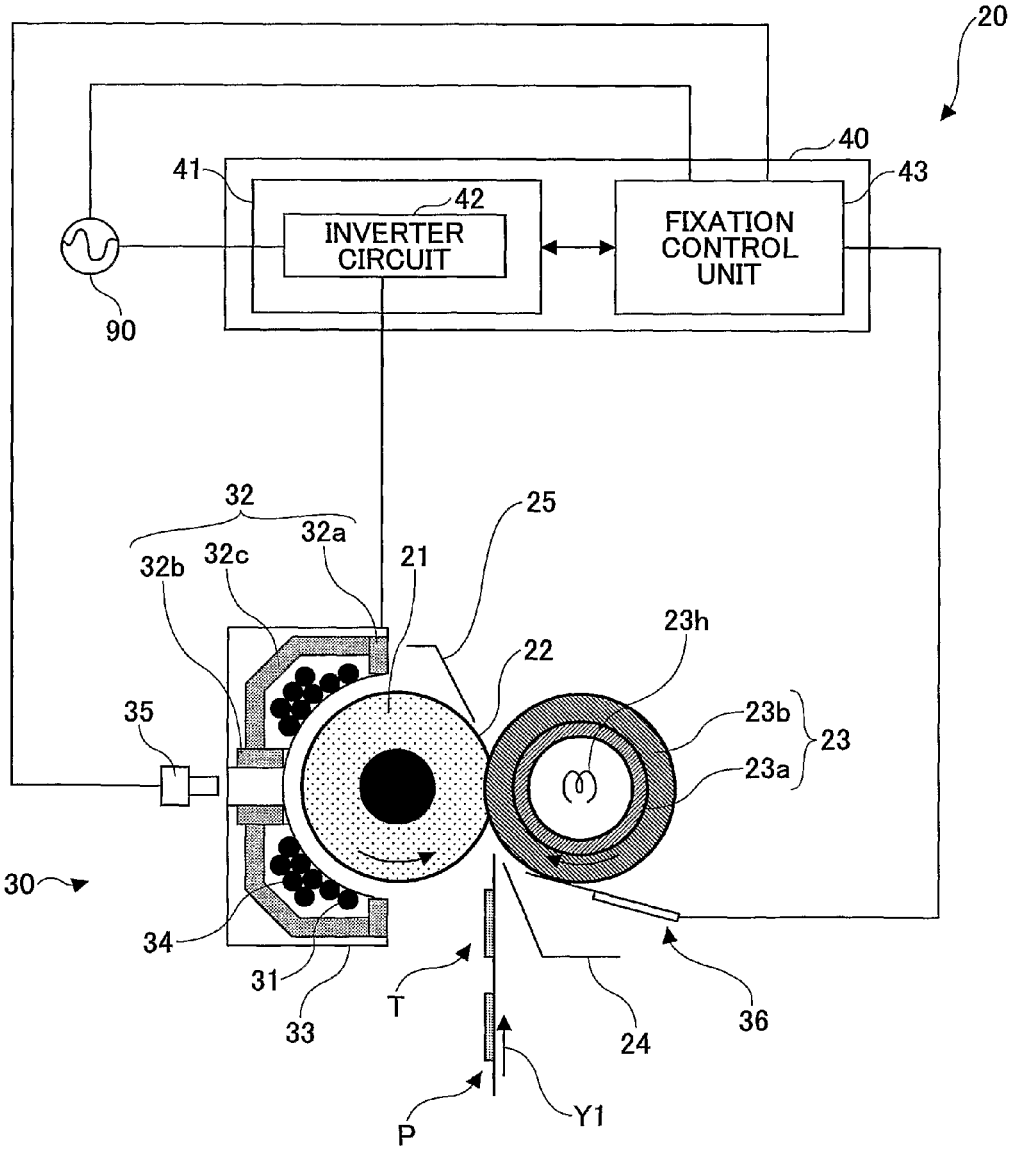
FIG. 2 is a schematic diagram illustrating a configuration of a fixation device according to an embodiment of the invention.

FIG. 2 is a schematic diagram illustrating the configuration of the fixation device 20 according to the embodiment of the invention.

The fixation device 20 includes an induction heating unit 30 serving as a magnetic flux generator, the fixation sleeve 22 serving as a fixation member and a heat generator (hereinafter also called "heat-application rotator"), a fixation roller 21 serving as a supporting member, and the pressure-application roller 23 serving as a pressure-application member (hereinafter also called "pressure-application rotator"). The fixation device 20 further includes a fixation control device 40 to control the induction heating unit 30.

Figure 3:
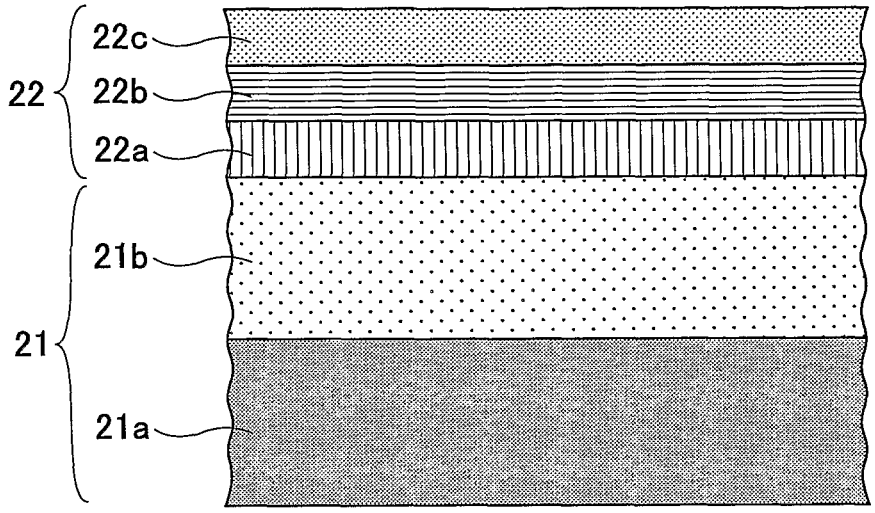
FIG. 3 is a cross-sectional diagram illustrating a fixation sleeve and a fixation roller provided in the fixation device of FIG. 2 according to the embodiment of the invention.

As illustrated in FIG. 3, the fixation sleeve as the heat generator includes a substrate 22*a* having a thickness of 30 to 50 μm and formed of a metallic material, a elastic layer 22*b* formed on the substrate 22*a*, and a release layer 22*c* formed on the elastic layer 22*b*. Preferable materials for the substrate 22*a* of the fixation sleeve 22 include magnetic metallic materials such as iron, cobalt, nickel and alloy of these magnetic metallic materials.

The elastic layer 22*b* of the fixation sleeve 22 is formed of an elastic material such as silicone rubber, and the thickness of the elastic layer 22*b* is approximately 150 μm. Since the elastic layer 22*b* having such a configuration does not have such a large heat capacity, consistently fixated images may be obtained.

A tube made from a fluorine compound such as PFA coats the release layer 22*c* of the sleeve 22, and the thickness of the release layer 22*c* is approximately 50 μm. The release layer 22*c* is utilized for improving the releasability of toner T directly attached to or in contact with a surface of the fixation sleeve 22.

The fixation roller 21 utilized as a supporting member includes a cylindrical cored bar 21*a* formed of a metallic material such as stainless steel, and a heat-resistant elastic layer 21*b* having silicone foam (i.e., foamed silicone rubber) formed on the cylindrical cored bar 21*a*. The outer diameter of the fixation roller 21 is approximately 40 mm. The elastic layer 21*b* of the fixation roller has a thickness of 9 mm. The fixation roller 21 is formed at the Asker hardness of 30 to 50 degrees. The fixation roller 21 is brought into contact with an inner circumference surface of the fixation sleeve 22 so as to support the thin fixation sleeve 22 in a roller shape. The fixation sleeve 22 may be or may not be adhered to the fixation roller 21.

The pressure-application roller 23 includes a cored bar 23*a* formed of a highly heat-conductive material such as aluminum or copper, a heat-resistant elastic layer 23*b* such as silicone rubber (solid rubber) formed on the cored bar 23*a*, and a release layer (not shown), which are layered in this order. The outer diameter of the pressure-application roller 23 is approximately 40 mm. The thickness of the elastic layer 23*b* of the pressure-application roller 23 is approximately 2 mm. A PFA tube coats the release layer of the pressure-application roller 23, and the thickness of the release layer is approximately 50 μm. The cored bar 23*a* includes a heater 23*h* such as a halogen heater that turns off at start-up of the fixation device 20 and turns on in standby mode of the fixation device 20. The pressure-application roller 23 is caused to press-contact the fixation roller 21 to form a recess portion on the fixation roller 21 side, that is, a nip portion, by the application of pressure from a pressure-application unit (not shown) via the fixation sleeve 22. The recording medium P is conveyed fixated to the nip portion formed between the pressure-application roller 23 and the recess portion of the fixation roller 21.

The induction heating unit 30 serving as a magnetic flux generator includes the exciting coil 31, a demagnetization coil unit 34, a core unit 32, and a coil guide 33 (coil housing). The exciting coil 31 includes turns of Litz wires, each formed of a bundle of thin lines, extendedly provided in a width direction on the coil guide 33 that is formed to cover part of an outer circumference of the sleeve 22.

The demagnetization coil unit 34 is symmetrically arranged on both ends of the fixation sleeve 22 in relation to a width direction of the recording medium P. The demagnetization coil unit 34 is placed on top of the exciting coil 31. The both ends of the symmetrically arranged demagnetization coil unit 34 are connected with a lead line to form a complete current path. The both ends of the demagnetization coil unit 34 is connected to a relay (not shown) located outside of the fixation device 20, thereby forming a closed circuit. A control circuit to apply or not to apply current to the demagnetization coil unit 34 controls the relay.

The coil guide 33 is formed of a resin material having a high heat resistance and is configured to support the exciting coil 31 and the demagnetization coil unit 34.

A core portion 32 is formed of a ferromagnetic material having relative magnetic permeability of approximately 2500 such as ferrite, and includes a side core 32*a*, a central core 32*b*, and an arch core 32*c* for generating an efficient magnetic flux towards the fixation sleeve 22. The core portion 32 arranged so as to face the exciting coil 31 extendedly provided in the width direction of the recording medium P.

The core portion 32 also includes a first temperature detection unit 36 to detect the temperature of the pressure-application roller 23. The first temperature detection unit 36 is attached to a roller surface of the pressure-application roller 23. The first temperature detection unit 36 measures a surface temperature of the pressure-application roller 23 to detect the accumulation of heat of the fixation device 20.

Figure 2A:
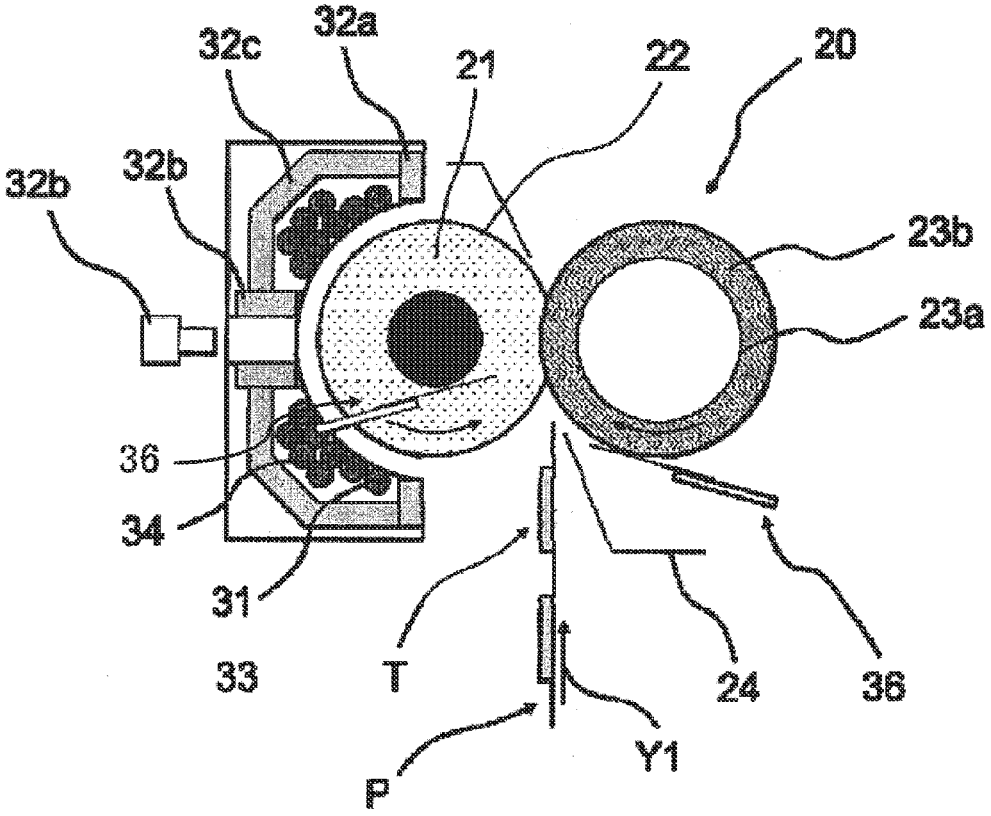
FIG. 2A is a schematic diagram illustrating a configuration of a fixation device according to another embodiment of the invention.

Alternatively, FIG. 2A illustrates that the first temperature detection unit 36 may be attached to a member adjacent to the fixation sleeve 22 to measure the ambient temperature as a thermistor. The accumulation of heat of the fixation device 20 may also be detected in this manner.

The fixation sleeve 22 includes a second temperature detection unit 35 to detect the temperature of the fixation sleeve 22. Preferably, the second temperature detection unit 35 is a thermopile that can measure a surface temperature of the fixation sleeve 22 without having to contact with a surface of the fixation sleeve 22. Note that the second temperature detection unit 35 can measure the ambient temperature between the second temperature detection unit 35 and the fixation sleeve 22, so that second temperature detection unit 35 may be used as the first temperature detection unit to detect the accumulation of heat of the fixation device 20.

The fixation device 20 having the above configuration operates as follows. The fixation sleeve 22 rotates in a clockwise direction when the pressure-application roller 23 is driven to be rotated in the clockwise direction shown in FIG. 2 by a driving motor (not shown). If the fixation roller 21 is not adhered to the fixation sleeve 22, the fixation roller 21 that supports the fixation sleeve 22 is not actively driven. The fixation sleeve 22 serving as a heat generator and a fixation member is heated at a position facing the induction heating unit 30 by the magnetic flux generated from the induction heating unit 30.

Specifically, a rectifier circuit in an IH control unit 41 rectifies an alternating voltage applied from a commercial power source 90, and the rectified voltage is converted into a high-frequency voltage by an inverter circuit 42. Magnetic lines of flux are alternately formed in either one of two directions in the vicinity of the exciting coil facing the fixation sleeve 22 by applying a high-frequency current of 10 kHz to 1 MHz from the inverter circuit 42 to the exciting coil 31. Thus, the formation of an alternating field generates an eddy current in the substrate 22*a* (heat generator and heat generating layer) of the fixation sleeve 22, and the substrate 22*a* is induction-heated by Joule's heat generated due to the electric resistance of the substrate 22*a*. The fixation sleeve 22 is thus induction-heated by the substrate 22*a*.

The surface of the fixation sleeve 22 that is heated by the induction heating unit 30 meets a corresponding position of the pressure-application roller 23 to form a nip portion. The recording medium is conveyed into the nip portion formed by the application of pressure from the pressure-application roller 23 on the surface of the fixation sleeve 22, thereby heating unfixated toner T (i.e., toner image) to melt on the recording medium P by the transmission of heat via the surface of the fixation sleeve 22.

Specifically, after the image forming process in which the toner image is formed on the recording medium P as described above, the recording medium P that carries the toner image T is conveyed into the nip portion (moved in a conveying direction indicated by an arrow Y1 in FIG. 2) between the fixation sleeve 22 and the pressure-application roller 23 while being guided by a guide plate 24. The toner image T is fixated on the recording medium P by the heat received from the fixation sleeve 22 and the pressure applied by the pressure-application roller 23, and the recording medium P having the fixated toner image is then discharged from the nip portion while being separated from the fixation sleeve 22 by a separator 25. The portion of the fixation sleeve 22 that has passed through the nip portion returns to a position so as to face the induction heating unit 30.

Note that if small sized recording media (sheets) consecutively pass through the nip portion of the fixation device, the relay forms a short circuit (ON) to generate a magnetic field in a direction reverse to the magnetic field of the exciting coil 31. Accordingly, the magnitude of the magnetic field decreases in an area where the demagnetization coil unit 34 is arranged, thereby preventing Joule's heat from generating in a non-medium (sheet) passing area of the sleeve 22. The sequence of operations is consecutively repeated to complete the fixation step of the image forming process.

Note that the induction heating unit 30 is controlled by the fixation control device 40. More specifically, the fixation control device 40 includes the IH control unit 41 connected to the induction heating unit 30. The IH control unit 41 includes the inverter circuit 42 that is connected to a fixation control unit 43 serving as a control unit. Further, the fixation control unit 43 is connected to the first temperature detection unit 36 detecting the temperature of the pressure-application roller 23 and also connected to the second temperature detection unit 35 detecting the temperature of the fixation sleeve 22. Further, the IH control unit 41 and the fixation control unit 43 are connected to the commercial power source 90 (e.g., 100 V, 15 A).

The fixation control unit 43 has two different control modes, namely, a power control mode and a temperature control mode, for the IH control unit 41 supplying the electric power to the exciting coil 31 of the induction heating unit 30. In the power control mode, it is preferable to apply the current to the exciting coil 31 by the maximum possible power supplied to the fixation device 20. In the temperature control mode, it is preferable to apply current to the exciting coil 31 based on PID feedback control (i.e., Proportional Integral Derivative Control including a PI control and a PD control). That is, it is preferable that the power supplied to the exciting coil 31 be determined based on the difference between the temperature of the fixation member (fixation sleeve 22) detected by the second temperature detection unit 35 and a target temperature of the fixation sleeve 22.

The fixation control unit 43 includes a control function to apply the current to the exciting coil 31 by switching the power control mode and the temperature control mode. Upon receiving a signal indicating that the current has been applied to the exciting coil 31 of the induction heating unit 30, the fixation control unit 43 selects one of the control modes. Specifically, if the temperature of the pressure-application member (i.e., pressure-application roller 23) detected by the first temperature detection unit 36 exceeds a threshold temperature, or if the ambient temperature of the fixation member (i.e., fixation sleeve 22) detected by the second temperature detection unit 35 having an additional function of the first temperature detection unit exceeds a threshold ambient temperature, the fixation control unit 43 selects the temperature control mode in which the power supplied to the exciting coil 31 is determined based on the temperature of the fixation sleeve 22 detected by the second temperature detection unit 35. By contrast, upon receiving a signal indicating that the current has been applied to the exciting coil 31 of the induction heating unit 30, if the temperature of the pressure-application roller 23 is equal to or lower than a threshold temperature, or if the ambient temperature of the fixation sleeve 22 is equal to or lower than a threshold ambient temperature, the fixation control unit 43 selects the power control mode in which a predetermined constant power is continuously applied to the exciting coil 31. In the selected power control mode, the fixation control unit 43 controls the IH control unit 41 to apply the current to the exciting coil 31.

Note that "upon receiving a signal indicating that the current has been applied to the exciting coil 31" indicates a case where a print request is transmitted to the image forming apparatus 1 by a user's operation of an operations panel or PC communication, and an instruction to apply the current to the exciting coil 30 is transmitted to the fixation control device 40 of the fixation device 20 based on the transmitted print request.

A first power supply control in the application of current to the exciting coil 31 at the start-up of the fixation device 20 is described with reference to FIG. 4.

Figure 4:
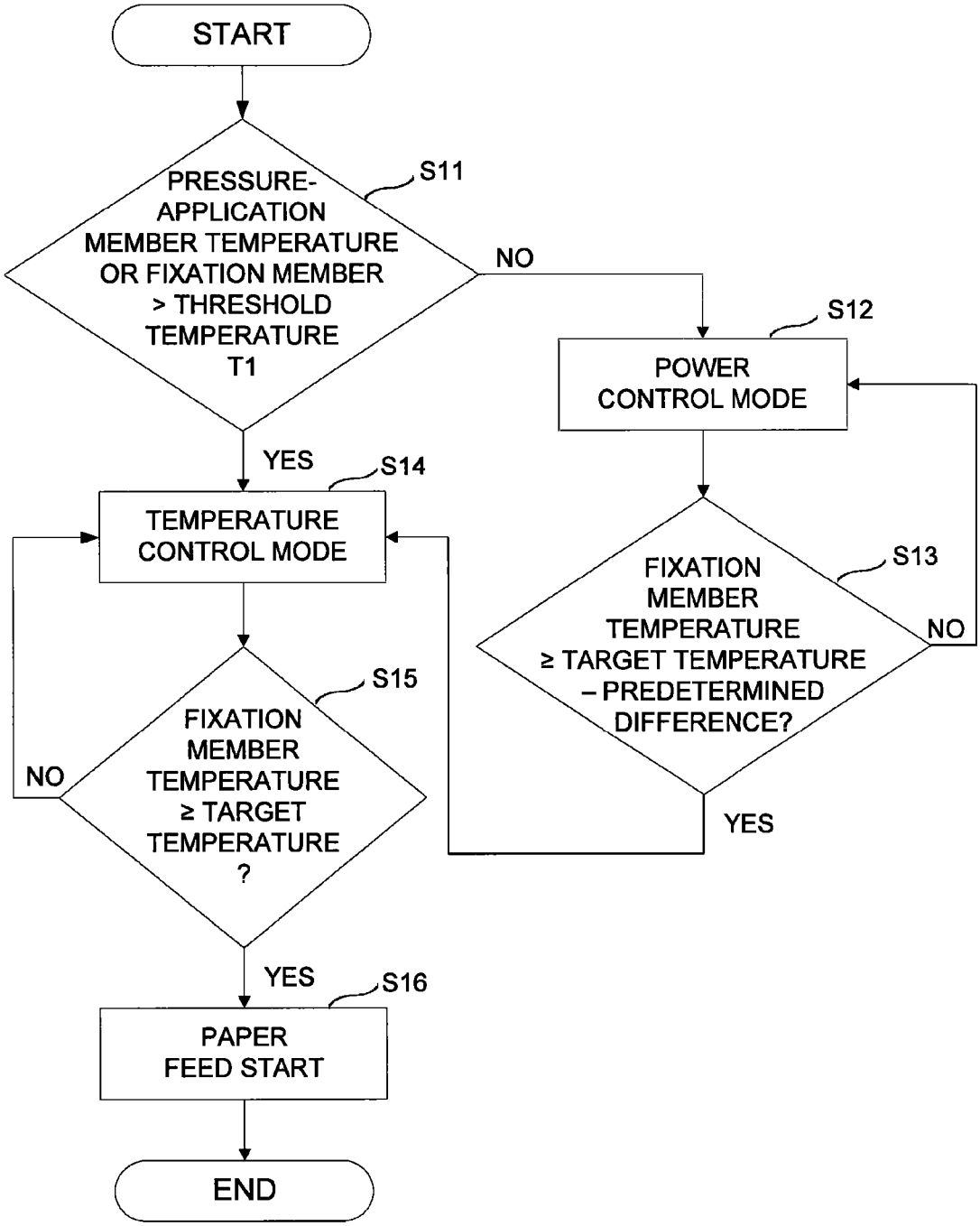
FIG. 4 is a flowchart illustrating a first power supply control of an exciting coil at start-up of the fixation device according to the embodiment of the invention.

FIG. 4 is a flowchart illustrating the first power supply control at the start-up of the fixation device 20 according to the embodiment of the invention. When the image forming apparatus 1 receives a print job in the standby mode or a OFF mode, the first power supply control according to the flowchart of FIG. 4 is activated in the fixation device 20 (START).

First, the first temperature detection unit 36 detects the temperature of the pressure-application roller 23 serving as a pressure-application member, and the fixation control unit 43 compares the detected temperature of the pressure-application roller 23 with a threshold temperature T1 (step S11). The threshold temperature T1 may be 80° C.

If the temperature of the pressure-application roller 23 is equal to or lower than the threshold temperature T1 (i.e., "No" in step S11), the fixation control unit 43 selects the power control mode based on the determination that the fixation device 20 has low (small) thermal accumulation. Upon selecting the power control mode, the fixation control unit 43 controls the IH control unit 41 to start applying a current to the exciting coil 31. The temperature of the fixation sleeve 22 in this stage rapidly rises (step S12). At this stage, an input power value to be supplied to the exciting coil 31 is the maximum possible power supplied to the fixation device in the power control mode (e.g., 1200 W (i.e., 100 V, 12 A)).

Next, the fixation control unit 43 determines whether the temperature of the fixation sleeve 22 detected by the second temperature detection unit 35 has reached a predetermined temperature obtained by (a target temperature of the fixation sleeve 22—a predetermined difference). The fixation control unit 43 selects the power control mode while the temperature of the fixation sleeve 22 is below the predetermined temperature (i.e., "No" in step S13) (step S13). If the temperature of the pressure-application roller 23 exceeds the threshold temperature T1 (i.e., "Yes" in step S11), the fixation control unit 43 selects the temperature control mode based on the determination of the fixation device 20 having high (large) thermal accumulation (step S14). Or if the temperature of the fixation sleeve 22 is equal to or higher than a temperature obtained by (a target temperature of the fixation sleeve 22—a predetermined difference) in step S13, the fixation control unit 43 switches the power control mode to the temperature control mode. The "predetermined difference" indicates an allowable temperature range in which the temperature of the fixation sleeve 22 does not exhibit an overshoot while the fixation control unit 43 switches the power control mode to the temperature control mode. At this stage, the power supplied from the IH control unit 41 to the exciting coil 31 is controlled based on the PID control corresponding to the target temperature of the fixation sleeve 22. The input power value for the exciting coil 31 is computed by the following equation (1). The temperature of the fixation sleeve 22 further increases when the computed power is supplied to the exciting coil 31. Note that the maximum input power at this state is the maximum possible power supplied to the fixation device in the temperature control mode (e.g., 950 W).

$$\text{Input power value}=Kp\{Tref-T\}+Kif\{Tref-T\}dt+KdU \quad (1)$$

In equation (1), Kp denotes a proportional constant, Ki denotes an integration constant, Kd denotes a differential constant, Tref denotes a target temperature, T denotes the temperature of the fixation sleeve 22 detected by the second temperature detection unit 35, and U denotes the rate of temperature rise of the fixation sleeve 22.

Next, the fixation control unit 43 determines whether the temperature of the fixation sleeve 22 detected by the second temperature detection unit 35 is equal to or higher than the target temperature of the fixation sleeve 22. The fixation control unit 43 selects the temperature control mode while the temperature of the fixation sleeve 22 is below the target temperature of the fixation sleeve 22 (step S15). When the temperature of the fixation sleeve 22 is equal to or higher than the target temperature of the fixation sleeve 22 (i.e., "Yes" in step S15), the recording medium (sheet) starts to be fed into the nip portion (step S16).

Figure 5:
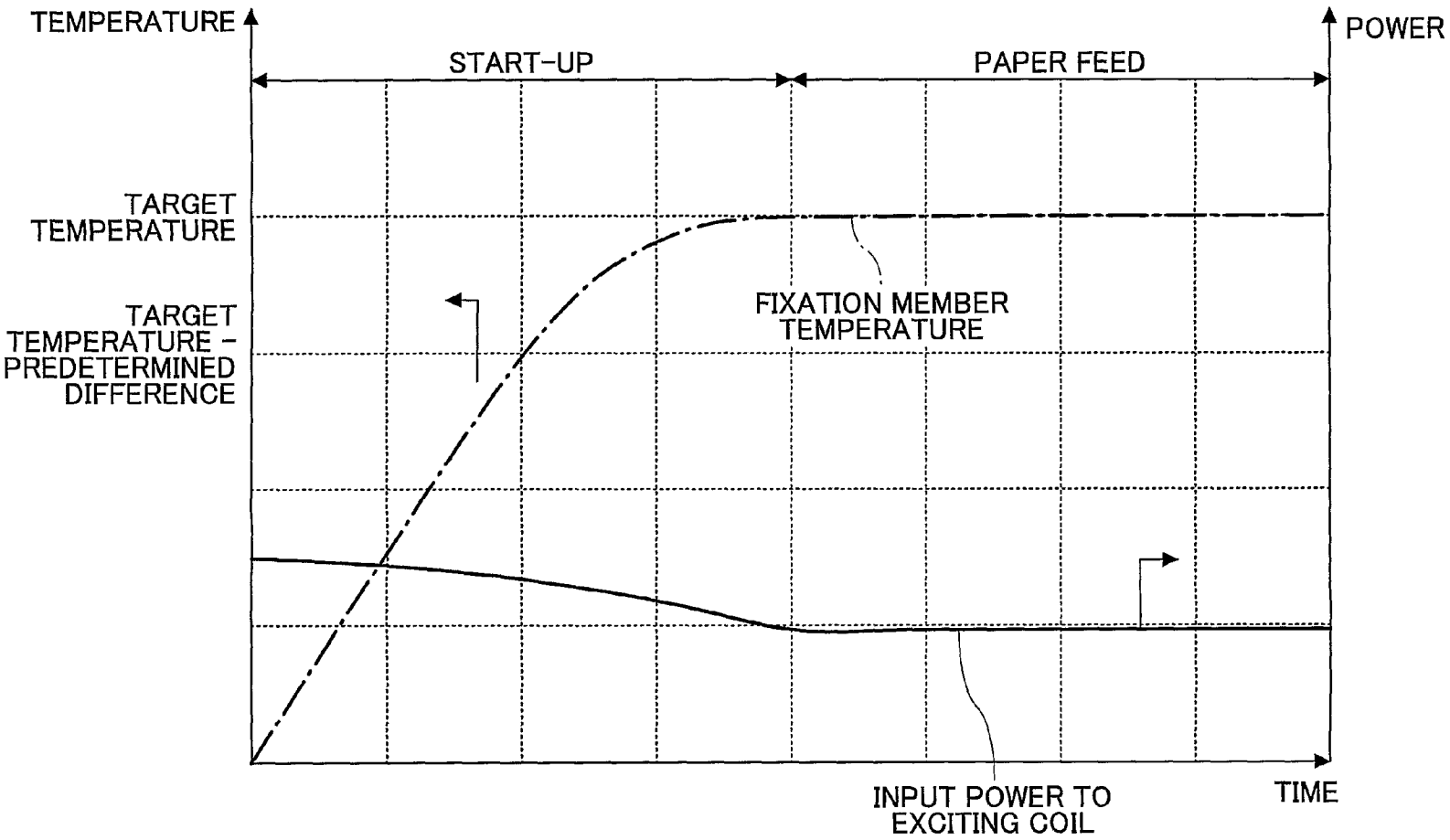
FIG. 5 is a graph illustrating a temperature change in the fixation member and a change in power supply to the exciting coil when a temperature control mode is selected during initial activation of an exciting coil in the first power supply control of the fixation device in FIG. 4.

FIG. 5 is a graph illustrating a temperature change in the fixation member (i.e., fixation sleeve 22) and a change in supplied power to the exciting coil when the temperature control mode is selected (i.e., "Yes" in step S11) when the current is applied to an exciting coil in the power supply control of the fixation device in FIG. 4. As illustrated in FIG. 5, the temperature of the fixation sleeve 22 reaches the target temperature in a relatively short warm-up time. As the temperature of the fixation sleeve 22 approaches the target temperature, the input power to the exciting coil 31 decreases. Thus, the temperature of the fixation sleeve 22 can be prevented from overshooting before the recording medium (sheet) is fed into the nip portion. As a result, the image forming apparatus is capable of forming excellent images before the recording medium (sheet) is fed into the nip portion.

Note that in step S11, when the fixation control unit 43 selects the control modes, the pressure-application roller 23 and the threshold temperature T1 are compared. However, alternatively, an ambient temperature of the fixation sleeve 22 detected by a thermistor attached to a member near the fixation sleeve 22 or the second temperature detection unit 35 may be compared with a threshold ambient temperature T2 to determine which of the control modes to be selected.

A second power supply control for applying the current to the exciting coil 31 at the start-up of the fixation device 20 is described with reference to FIG. 6.

Figure 6:
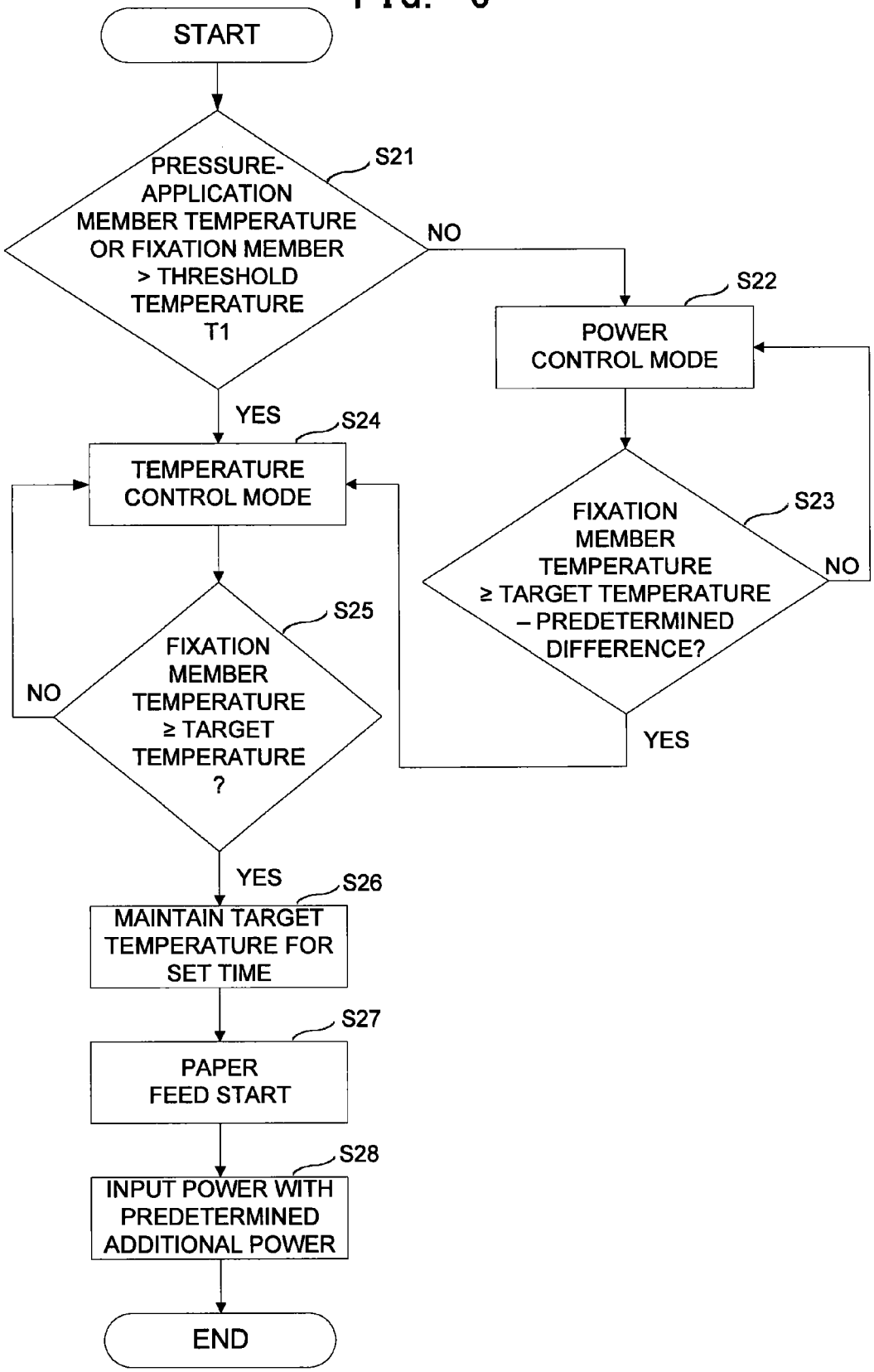
FIG. 6 is a flowchart illustrating a second power supply control of the exciting coil in the fixation device according to the embodiment of the invention.

FIG. 6 is a flowchart illustrating the second power supply control to the exciting coil in the fixation device according to the embodiment of the invention. The second power supply control according to the flowchart of FIG. 6 is initiated in the fixation device 20 when the fixation device 20 receives a print job in the standby mode of the image forming apparatus 1. Note that since steps S21 through S25 in FIG. 6 are the same control as the steps S11 through S15 in FIG. 4, the descriptions of these steps are omitted, and thus steps S26 through S28 are described below (START).

If the temperature of the fixation sleeve 22 is equal to or higher than the target temperature of the fixation sleeve 22 ("Yes" in step S25), or in other words, if the temperature of the fixation sleeve 22 has reached the target temperature of the fixation sleeve 22 for the first time, the fixation control unit 43 controls the IH control unit 41 to apply the current to the exciting coil 31 for a predetermined time (set time t1) such that the temperature of the fixation sleeve can be maintained at the target temperature thereof. Thereafter, the recording medium (sheet) is fed into the nip portion (steps S26 and S27).

Figure 7:
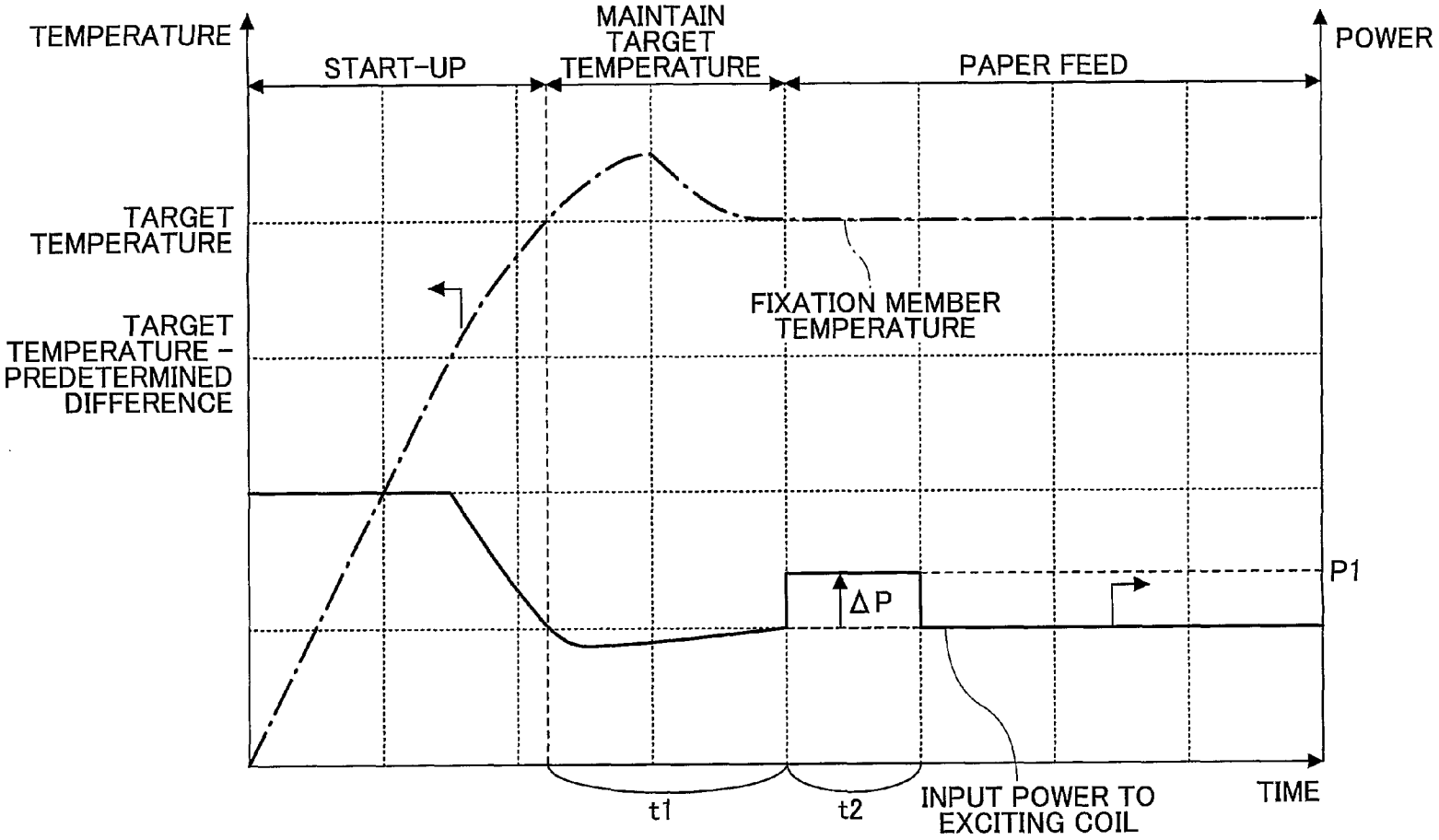
FIG. 7 is a graph illustrating a temperature change in the fixation member and a change in the power supply of the exciting coil when the power control mode that is selected to supply the maximum power to the exciting coil is switched to the temperature control mode.

As illustrated in FIG. 7, the temperature of the fixation sleeve 22 may slightly overshoot the target temperature thereof after having reached the target temperature of the fixation sleeve 22 for the first time at the start-up of the fixation device 20. That is, the temperature of the fixation sleeve 22 may slightly overshoot the target temperature thereof, when the maximum power is supplied to the exciting coil 31 in the power control mode selected by the fixation control unit 43. Accordingly, the current applied to the exciting coil 31 is controlled so as to maintain the temperature of the fixation sleeve 22 at the target temperature of the fixation sleeve 22. In this manner, feeding of the recording medium (sheet) (paper feed) is stopped while the temperature of the sleeve 22 exhibits an overshoot and the feeding starts when the overshoot decreases.

Alternatively, in steps S26 and S27, when the current is first applied to the exciting coil 31 and the temperature of the fixation sleeve 22 has exceeded the target temperature of the fixation sleeve 22 for the first time, the feeding of the recording medium (sheet) (paper feed) is started at the time where the temperature of the fixation sleeve 22 detected by the second temperature detection unit 35 is lower than the target temperature thereof.

The fixation control unit 43 continuously selects the temperature control mode when feeding the recording medium (sheet) into the nip portion. The fixation control unit 43 controls the IH control unit 41 such that a predetermined additional power (ΔP) is added to the power determined in the temperature control mode to control the application of the current to the exciting coil 31 in a predetermined time (set time t2) from the starting of feeding the recording medium (sheet) (step S28). In this manner, response delay caused by a single PID feedback control can be compensated by a feed-forward control, in which the set power P1 that includes ΔP is supplied to the exciting coil 31 during the set time t2. As a result, temperature drop caused by the recording medium P (or recording medium (sheet)) removing heat from the fixation sleeve 22 may be prevented.

Next, a third power supply control for applying the current to the exciting coil 31 at the start-up of the fixation device 20 is described with reference to FIG. 8.

In this model, the thermal accumulation of the fixation device 20 is determined based on the temperature of the pressure-application roller 23 (i.e., temperature detected by the first temperature detection unit 36; hereinafter also called "pressure thermistor temperature") and an ambient temperature of the fixation sleeve 22 (temperature detected by the thermistor attached to a member near the fixation sleeve 22 or detected by the second temperature detection unit 35; hereinafter also called "fixation thermistor ambient temperature"). Specifically, the thermal accumulation of the fixation device 20 is determined as follows.

(1) If pressure thermistor temperature≤threshold temperature T1, AND fixation thermistor ambient temperature≤threshold temperature (threshold ambient temperature) T2, the thermal accumulation=cold (small);

(2) If pressure thermistor temperature>threshold temperature T1, AND fixation thermistor ambient temperature≤threshold temperature T2, the thermal accumulation=warm (relatively small); and (3) If pressure thermistor temperature>threshold temperature T1, AND fixation thermistor ambient temperature>threshold temperature T2, the thermal accumulation=hot (large).

The above (1) indicates a condition where the thermal accumulation of an entire fixation unit (i.e., fixation device 20) is small (i.e., cold), the above (2) indicates a condition where the surface of the pressure-application roller 23 is hot but the thermal accumulation of the entire unit is relatively small (i.e., warm), and the above (3) indicates a condition where the thermal accumulation of the entire unit is large (i.e., hot).

Figure 8:
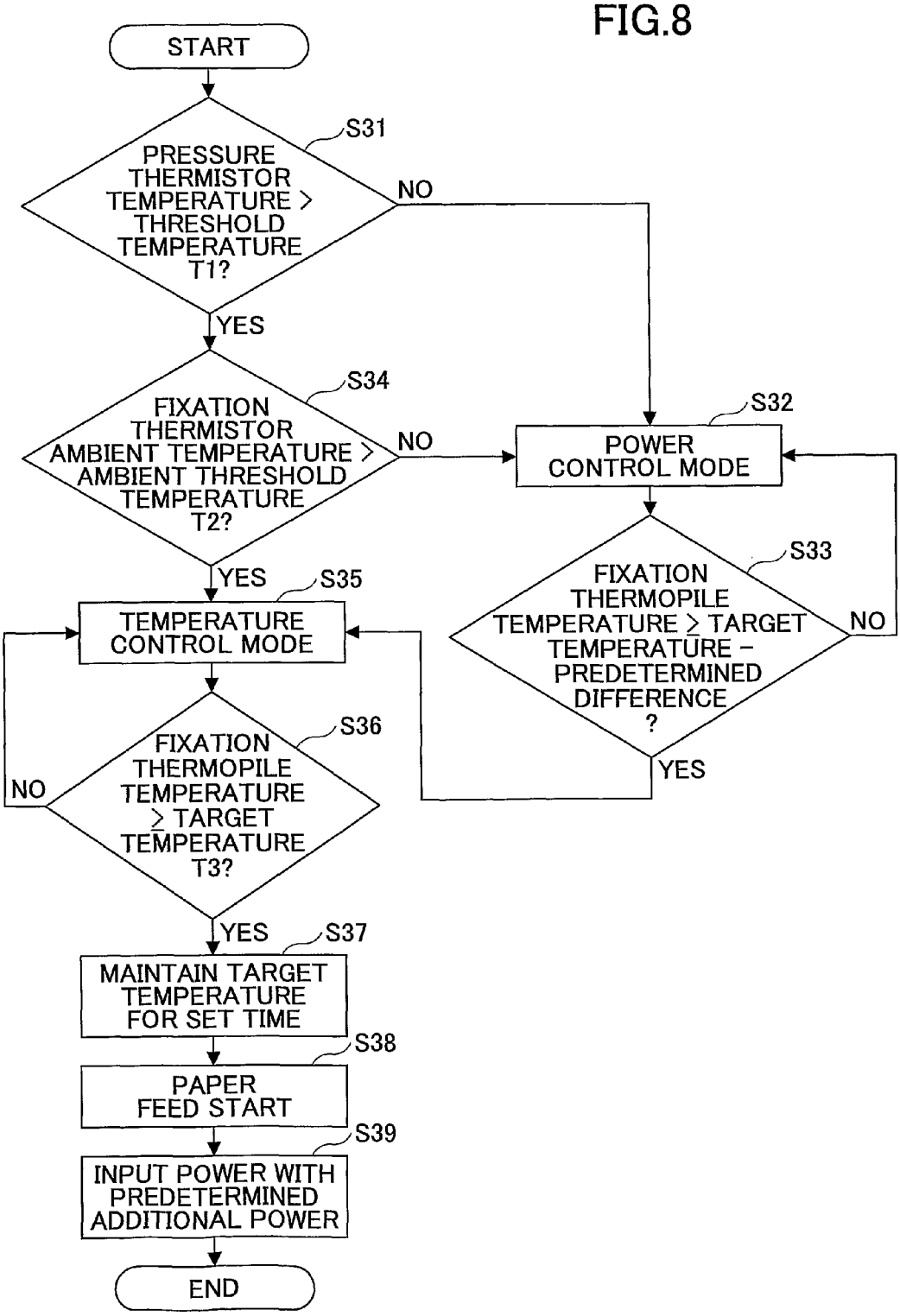
FIG. 8 is a flowchart illustrating a third power supply control of the exciting coil in the fixation device according to the embodiment of the invention.

FIG. 8 is a flowchart illustrating a third power supply control to the exciting coil in the fixation device according to the embodiment of the invention.

The third power supply control according to the flowchart of FIG. 8 is initiated in the fixation device 20 when the fixation device 20 receives a print job in the standby mode or a OFF mode of the image forming apparatus 1 (START).

First, the first temperature detection unit 36 detects the temperature of the pressure-application roller 23, and the fixation control unit 43 compares the detected temperature of the pressure-application roller 23 (i.e., pressure thermistor temperature) with a predetermined threshold temperature T1 (step S31). If the temperature of the pressure-application roller 23 is equal to or lower than the threshold temperature T1 ("No" in step S31), the fixation control unit 43 selects the power control mode based on the determination of the fixation device 20 to have small thermal accumulation (cold). Upon selecting the power control mode, the fixation control unit 43 controls the IH control unit 41 to initiate application of current to the exciting coil 31. The temperature of the fixation sleeve 22 in this stage rises rapidly (step S32). At this stage, an input power value to be supplied to the exciting coil 31 is the maximum possible power supplied to the fixation device in the power control mode (e.g., 1200 W (i.e., 100 V, 12 A)).

Next, the fixation control unit 43 determines whether the temperature of the fixation sleeve 22 (i.e., fixation thermopile temperature) detected by the second temperature detection unit 35 has reached a predetermined temperature obtained by (a target temperature of the fixation sleeve 22—a predetermined difference). The fixation control unit 43 selects the power control mode while the temperature of the fixation sleeve 22 is below the predetermined temperature (i.e., "No" in step S33) (step S33). When the temperature of the pressure-application roller 23 exceeds the threshold temperature T1 ("Yes" in step S31), the thermistor detects the ambient temperature of the fixation sleeve 22, the fixation control unit 43 compares the detected ambient temperature (i.e., fixation thermistor temperature) with the predetermined threshold temperature (threshold ambient temperature) T2 (step S34). If the ambient temperature of the fixation sleeve 22 is equal to or lower than the threshold temperature T2 ("No" in step S34), the fixation control unit 43 selects the power control mode based on the determination that the fixation device 20 has a relatively low (relatively small) thermal accumulation (warm). Upon selecting the power control mode, the fixation control unit 43 controls the IH control unit 41 to initiate application of current to the exciting coil 31. The temperature of the fixation sleeve 22 in this stage rises rapidly (step S32). If the temperature of the fixation sleeve 22 exceeds the threshold temperature T2 (i.e., "Yes" in step S34), the fixation control unit 43 selects the temperature control mode based on the determination that the fixation device 20 has a high (large) thermal accumulation (hot) (step S35). Or if the temperature of the fixation sleeve 22 is equal to or higher than a temperature obtained by (a target temperature of the fixation sleeve 22—a predetermined difference) in step S33, the fixation control unit 43 switches the power control mode to the temperature control mode. In this stage, the power supplied to the exciting coil 31 is controlled based on the PID control corresponding to the target temperature of the fixation sleeve 22. The input power value of the exciting coil 31 is computed by the following equation (1).

$$\text{Input power value}=Kp\{Tref-T\}+Kif\{Tref-T\}dt+KdU \quad (1)$$

Next, the fixation control unit 43 determines whether the temperature of the fixation sleeve 22 (i.e., fixation thermopile temperature) detected by the second temperature detection unit 35 is equal to or higher than the target temperature T3 of the fixation sleeve 22. The fixation control unit 43 selects the temperature control mode while the temperature of the fixation sleeve 22 is below the target temperature of the fixation sleeve 22 (step S35). Thereafter, steps S37 through S39 respectively including the same controls as the steps S26 through S28 are performed.

Thus, in the fixation device 20 having the above configuration, the thermal accumulation of the fixation device 20 before the start-up (i.e., temperature of the pressure-application roller 23 or ambient temperature of the fixation sleeve 22) is detected in advance. If the thermal accumulation of the fixation device 20 is large (i.e., thermal accumulation=hot or high), the fixation control unit 43 selects the temperature control mode to apply current to the exciting coil 31. In this manner, the fixation device 20 can start up in the temperature control mode without being initially operated in the power control mode, thereby lowering the overshoot temperature of the fixation sleeve 22. Note that if the thermal accumulation is sufficient (large), the fixation device 20 can be sufficiently heated in the temperature control mode (i.e., without maximum power supply) in a short warm-up time. By contrast, if the accumulated temperature of the fixation device 20 is small or relatively small (i.e., cold or warm), the fixation control unit 43 can select the power control mode to shorten the warm-up time.

Figure 9:
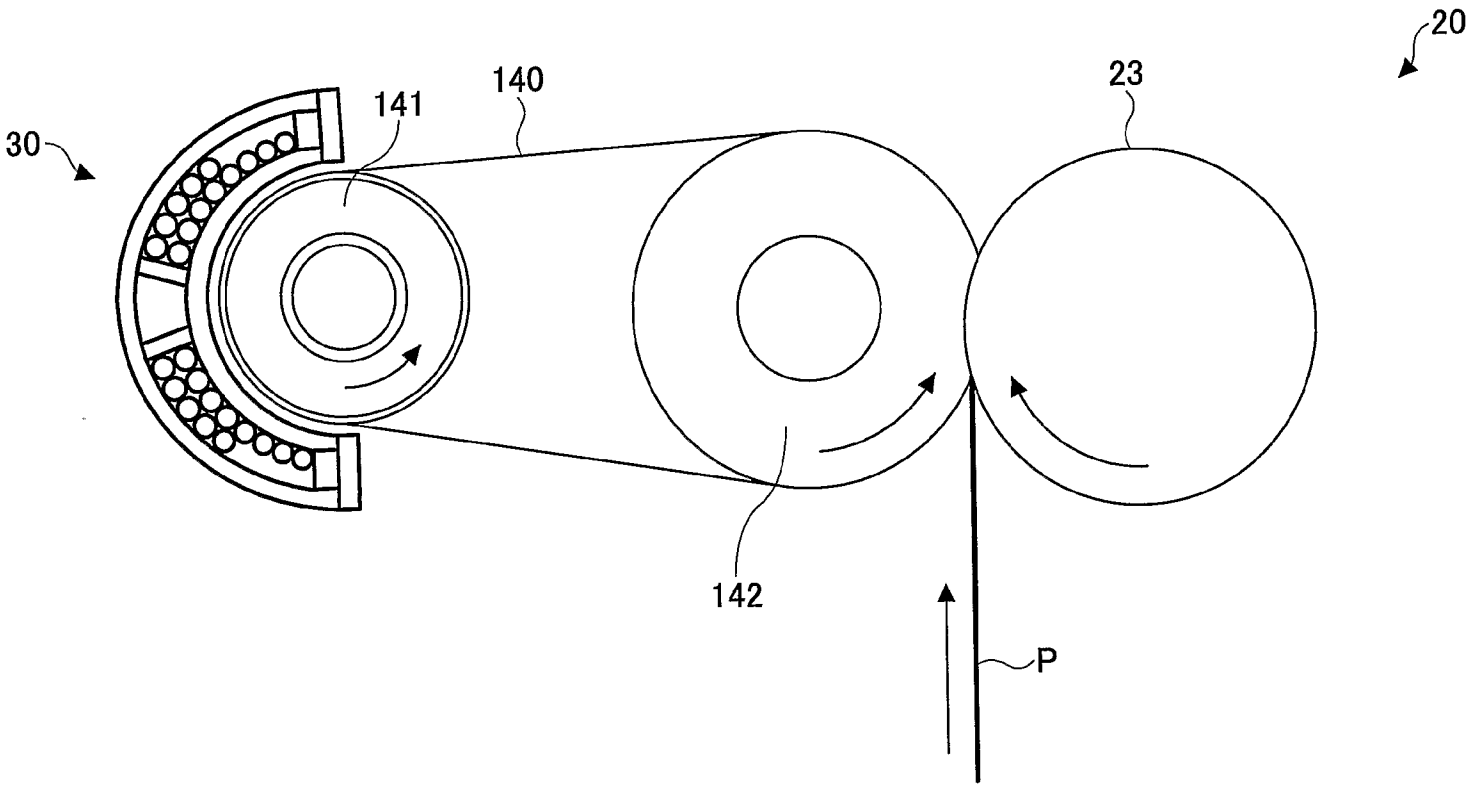
FIG. 9 is a cross-sectional diagram illustrating another configuration of a fixation device according to an embodiment of the invention.
Figure 10:
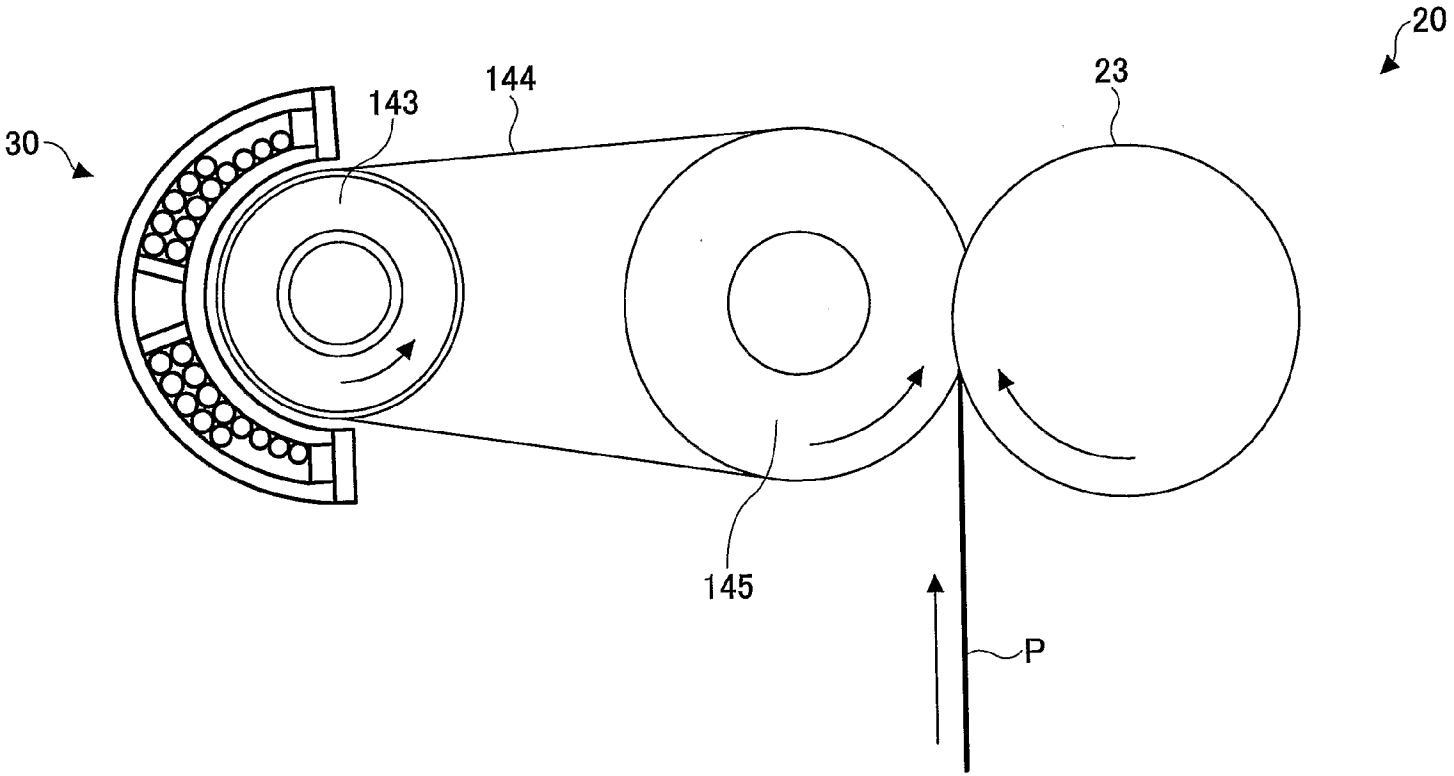
FIG. 10 is a cross-sectional diagram illustrating still another configuration of a fixation device according to an embodiment of the invention.
Figure 11:
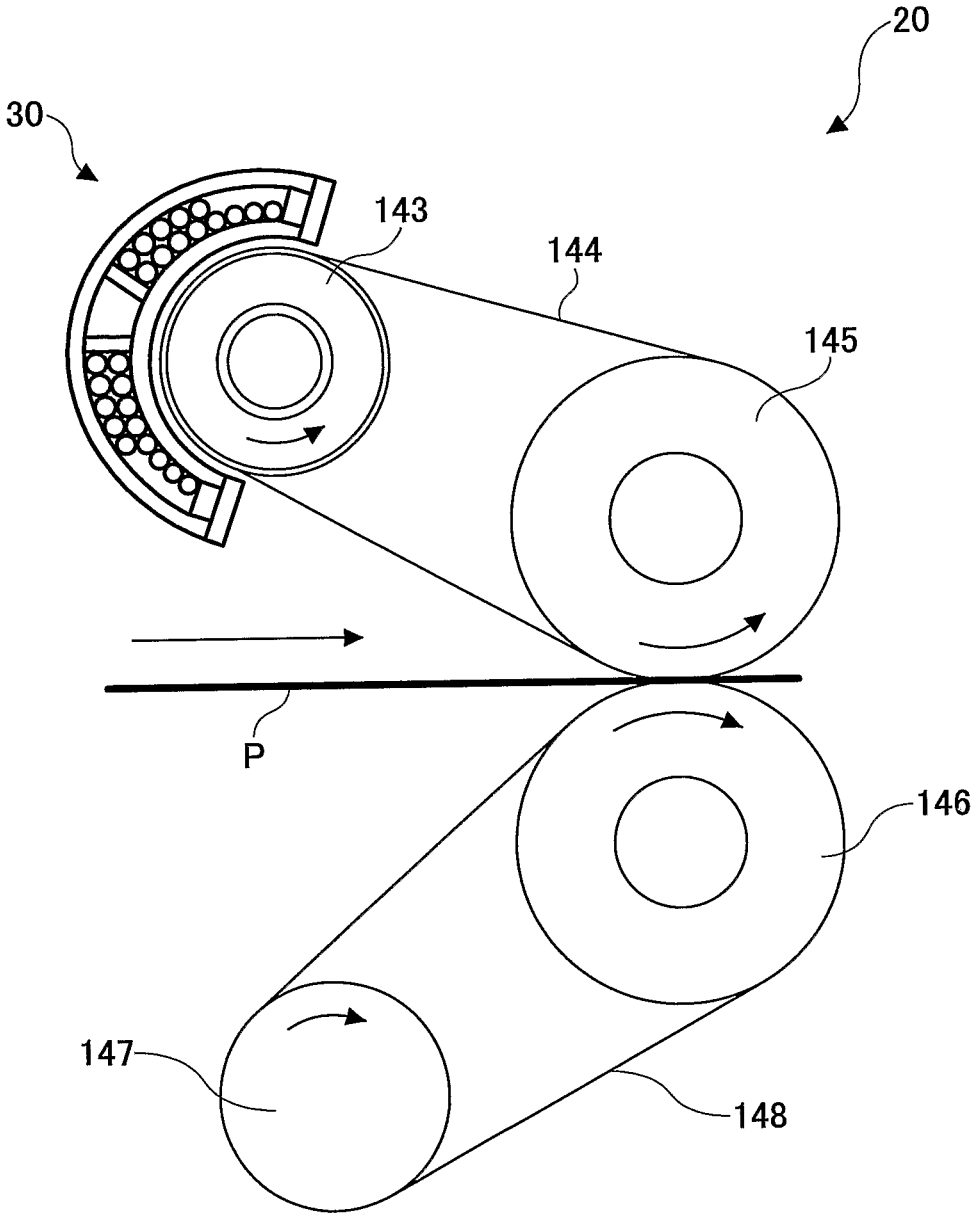
FIG. 11 is a cross-sectional diagram illustrating yet another configuration of a fixation device according to an embodiment of the invention.

Although the above embodiments are described with reference to the drawings, the invention is not limited to the embodiments illustrated in the drawings. Various other modifications, changes, alternations and deletion that would have been conceived by those skilled in the art may be made without departing from the scope of the invention, and are intended to be included within the scope of the following claims. For example, in the embodiment of the invention, the fixation sleeve 22 illustrated in FIG. 3 is described as a fixation member. However, the fixation sleeve 22 may be a fixation heating belt 140 illustrated in FIG. 9 that generates heat, and the fixation heating belt 140 may be looped over a supporting roller 141 and a fixation rotator 142 so that the fixation heating belt 140 may be driven to rotate about them. Further, as illustrated in FIG. 10, a fixation belt 144 is looped over a heating roller 143 and a fixation rotator 145, so that heat generated by the heating roller 143 may be transmitted to the recording medium P via the fixation belt 144. Moreover, as a modification of the pressure-application member, a pressure application belt 148, which is looped over a pressure-application supporting roller 146 and a supporting roller 147 as illustrated in FIG. 11, may be used instead of the pressure-application roller 23 of the fixation device illustrated in FIG. 10.

According to the embodiment of the invention, in the fixation device having the above configuration, the thermal accumulation of the fixation device 20 before the start-up (i.e., temperature of the pressure-application member or ambient temperature of the fixation member) is detected in advance. If the thermal accumulation of the fixation device is large, the current is applied to the exciting coil in the temperature control mode. In this manner, the fixation device can start up in the temperature control mode without being initially operated in the power control mode, thereby lowering the overshoot temperature of the fixation member. Note that if the thermal accumulation is sufficient (large), the fixation device can be sufficiently heated in the temperature control mode (i.e., without maximum power supply) in a short warm-up time. By contrast, if the accumulated temperature of the fixation device 20 is small or relatively small (i.e., cold or warm), the power control mode is selected to shorten the warm-up time. For example, time from the start-up to first printing may take 30 sec.

According to the embodiment of the invention, in the fixation device having the above configuration, the PID control corresponding to the target temperature of the fixation member is used as the temperature control mode. If the difference between the temperature of the fixation member detected by the second temperature detection unit and the target temperature is large, the power applied to the exciting coil may be increased. If the difference is small, the power applied to the exciting coil may be reduced. In this manner, the start-up time of the fixation device may be reduced and the overshoot temperature of the fixation device may also be lowered.

According to the embodiment of the invention, in the power control mode of the fixation device having the above configuration, the maximum power supplied to the fixation device may be supplied to the exciting coil. In this manner, the start-up time of the fixation device may be reduced.

According to the embodiment of the invention, when the temperature of the fixation member has reached the temperature obtained by (target temperature—predetermined difference), the power control mode of the fixation device having the above configuration may be switched to the temperature control mode. In this manner, the delay in control may be compensated, and the overshoot temperature of the fixation device may also be lowered.

According to the embodiment of the invention, when the temperature of the fixation member has reached the target temperature, the temperature of the fixation member is maintained at the target temperature of the fixation member for a predetermined time. Thereafter, the recording medium (paper) is allowed to pass through the nip portion of the fixation device. In this manner, the recording medium (paper) may pass through the region of the fixation member having a stabilized temperature.

According to the embodiment of the invention, the recording medium (paper) passes through the nip portion of the fixation device after the temperature of the fixation member that has overshot the target temperature is reduced to the target temperature. In this manner, the recording medium (paper) can pass through the region of the fixation member having a stabilized temperature.

According to the embodiment of the invention, the feed-forward control is used to compensate the temperature drop of the fixation member that occurs immediately after starting to feed the recording medium (paper) into the nip portion of the fixation device. With the feed-forward control, the power is supplied with the additional compensational power to the exciting coil. In this manner, the recording medium (paper) can pass through the region of the fixation member having a stabilized temperature.

According to the embodiment of the invention, the fixation device can start up in the reduced warm-up time while preventing the temperature of the fixation member from overshooting. Thus, the fixation device is capable of quickly starting up and providing stable and uniform images.

The present invention is not limited to the specifically disclosed embodiment, and variations and modifications may be made without departing from the scope of the present invention.

This patent application is based on Japanese Priority Patent Application No. 2009-065453 filed on Mar. 18, 2009, the entire contents of which are hereby incorporated herein by reference.

The invention claimed is:

1. A fixation device comprising:

a fixation member configured to include a heating member;

a pressure-application member configured to press-contact the fixation member to form a nip portion therebetween;

an exciting coil configured to induction-heat the heating member of the fixation member;

a first temperature detection unit configured to detect a first temperature of the pressure-application member;

a second temperature detection unit configured to detect a second temperature of the fixation member;

a third temperature detection unit configured to detect an ambient temperature in the neighborhood of the fixation member; and a control unit, wherein the control unit, upon receiving a signal indicating that current has been applied to the exciting coil, determines that a heat storing state is a cold state when the first temperature of the pressure-application member detected by the first temperature detection unit is equal to or lower than a first threshold temperature, determines that the heat storing state is a warm state when the first temperature of the pressure-application member is higher than the first threshold temperature, and the ambient temperature in the neighborhood of the fixation member detected by the third temperature detection unit is equal to or lower than an ambient threshold temperature, and determines that the heat storing state is a hot state when the first temperature of the pressure-application member is higher than the first threshold temperature, and the ambient temperature in the neighborhood of the fixation member is higher than the ambient threshold temperature, wherein the control unit controls electric power supplied to the exciting coil, by selecting a power control mode when the heat storing state is the cold state or the warm state, to continuously supply a predetermined level of the electric power to the exciting coil, or by selecting a temperature control mode when the heat storing state is the hot state, without transitioning to the power control mode, to supply the electric power determined based on the second temperature of the fixation member detected by the second temperature detection unit, to the exciting coil, wherein a reference temperature for transitioning from the power control mode to the temperature control mode, and a target temperature of the fixation device in the temperature control mode are set for the second temperature of the fixation member detected by the second temperature detection unit.

2. The fixation device as claimed in claim 1, wherein the temperature control mode includes a PID feedback control in which the electric power supplied to the exciting coil is determined based on a difference between the second temperature of the fixation member detected by the second temperature detection unit and a target temperature of the fixation member.

3. The fixation device as claimed in claim 1, wherein in the power control mode, the electric power supplied to the exciting coil is a maximum power supplied to the fixation device.

4. The fixation device as claimed in claim 1, wherein the control unit selects, while supplying the electric power to the exciting coil in the power control mode, the temperature control mode at a time when the second temperature of the fixation member detected by the second temperature detection unit has reached a third temperature that is a predetermined different value lower than a target temperature of the fixation member.

5. The fixation device as claimed in claim 1, wherein when the electric power is supplied to the exciting coil and the second temperature of the fixation member detected by the second temperature detection unit has reached a target temperature of the fixation member for a first time, the control unit controls the electric power supplied to the exciting coil such that the second temperature of the fixation member is retained at the target temperature of the fixation member for a predetermined duration, and a recording medium is started to pass through the fixation device after the second temperature of the fixation member has been retained at the target temperature of the fixation member for the predetermined duration.

6. The fixation device as claimed in claim 1, wherein when the electric power is supplied to the exciting coil and the second temperature of the fixation member detected by the second temperature detection unit exceeds a target temperature of the fixation member for a first time, a recording medium is started to pass through the fixation device at a time when the second temperature of the fixation member detected by the second temperature detection unit has fallen below the target temperature of the fixation member again.

7. The fixation device as claimed in claim 1, wherein when a recording medium is started to pass through the fixation device, the control unit selects the temperature control mode to control the electric power supplied to the exciting coil such that the electric power determined by the temperature control mode includes a predetermined additional electric power, and the electric power determined by the temperature control mode including the predetermined additional electric power is supplied to the exciting coil for a predetermined duration since the recording medium has been started to pass through the fixation device.

8. An image forming apparatus comprising the fixation device as claimed in claim 1.

* * * * *